US006354956B1

(12) United States Patent
Doong

(10) Patent No.: US 6,354,956 B1
(45) Date of Patent: Mar. 12, 2002

(54) GOLF CLUB HEAD WITH RESILIENT MOVABLE

(76) Inventor: Kun-Ming Doong, No. 38, Alley 4, Lane 194, Jui-Lung Rd., Chien-Chen Dist. Kaohsiung Hsien (TW)

( * ) Notice: Subject to any disclaimer, the term of this patent is extended or adjusted under 35 U.S.C. 154(b) by 0 days.

(21) Appl. No.: 09/563,334

(22) Filed: May 3, 2000

(51) Int. Cl.[7] ..... A63B 69/36; A63B 53/06

(52) U.S. Cl. ..... 473/219; 473/328; 473/329; 473/333; 473/335

(58) Field of Search ..... 473/324, 328, 473/329, 349, 350, 333, 334, 345, 223, 219, 292, 332, 335, 225, 238, 242, 244, 256

(56) References Cited

U.S. PATENT DOCUMENTS 925,389 A * 6/1909 Royce
5,333,861 A * 8/1994 Mills
5,499,814 A * 3/1996 Lu
5,505,453 A * 4/1996 Mack
5,620,377 A * 4/1997 Glockner

* cited by examiner

*Primary Examiner*—Sebastiano Passaniti

(57) ABSTRACT

A golf club head with resilient bodies is designed by introducing a concept of movable body to build a casing including a faceplate and a limitation stopper, then dispose at least a resilient element inside for connecting and positioning the casing with a main housing of club head to thereby complete a resilient golf club head. The novel golf club head is taking advantage of buffer function of the enclosed resilient element to have defects of the conventional golf club head eliminated and provide a secondary auxiliary elastic force, reduce resistant force, and offer stable displacement of the center of gravity of the club head.

2 Claims, 4 Drawing Sheets

GOLF CLUB HEAD WITH RESILIENT MOVABLE

BACKGROUND OF THE INVENTION

This invention relates generally to a golf club head, more particularly, it relates to a novel golf club head with resilient movable bodies.

Generally speaking, a golf club head usually comprises a striking faceplate, a bottom plate, and an upper cover. In consideration of striking a golf ball farther, makers are doing their best endeavor to study and search new materials for any possible breakthrough helpful in creating a powerful faceplate structure. However, if control problem is ignored in searching for a material, a powerful golf club may become as uncontrollable as a wild horse without a bridle. The bottom plate—the portion where center of gravity of a club head locates—is usually weighted to lower down the center of gravity in considering stabilization by protruding it downwards, which is liable to strike the ground and scratched to create a resistant force.

In view of abovesaid imperfections, after years of constant effort in research, the inventor of this invention has consequently developed and proposed an improved structure pertaining to the subject matter.

SUMMARY OF THE INVENTION

The primary object of this invention is to provide a golf club head with resilient movable bodies to dissolve problem of ball control and resistant force of a conventional club head.

In order to realize abovesaid object, this invention is characterized in: using at least a resilient element to connect a faceplate and a limitation stopper with a main housing of a golf club head, wherein the resilient faceplate will create a secondary auxiliary force for striking a golf ball farther, and, the resilient bottom plate is withdrawable when striking the ground to thus reduce the resistance; placing a movable body in toe end, which is withdrawable when striking the ground for reduction of resistance.

For more detailed information regarding this invention together with further advantages or features thereof, at least an example of preferred embodiment will be elucidated below with reference to the annexed drawings.

BRIEF DESCRIPTION OF THE DRAWINGS

The related drawings in connection with the detailed description of this invention to be made later are described by the drawings which are given by way of illustration only, and thus are not limitative of the present invention, and in which.

DETAILED DESCRIPTION OF THE PREFERRED EMBODIMENT

Figure 1:
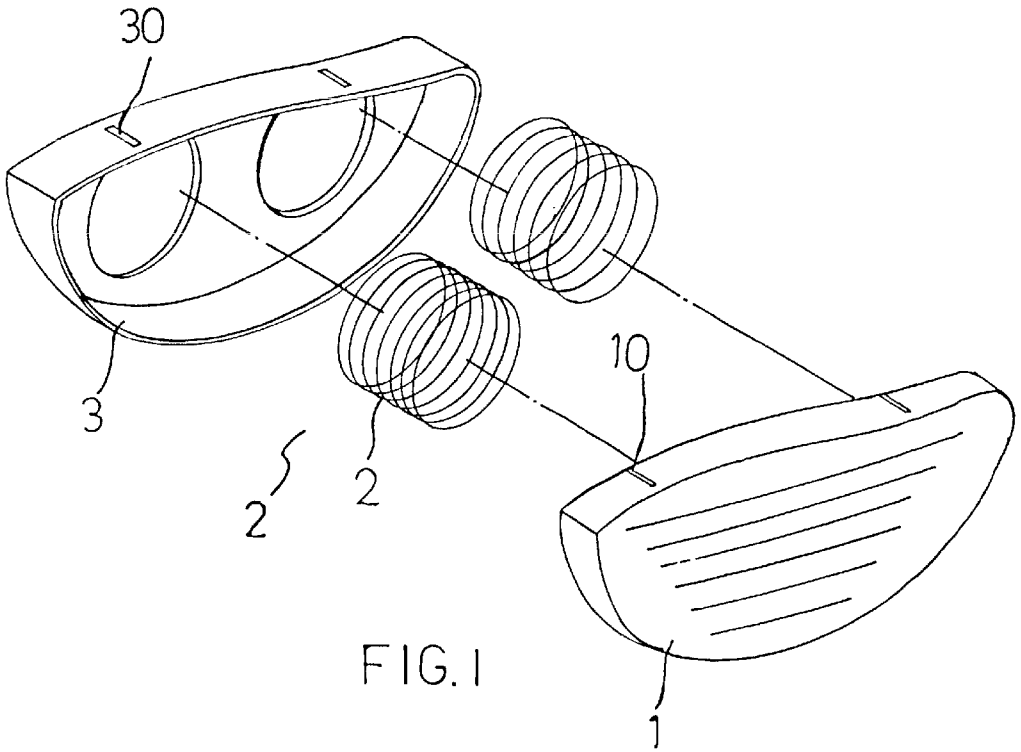
FIG. 1 is an exploded view illustrating a movable body of this invention.
Figure 2:
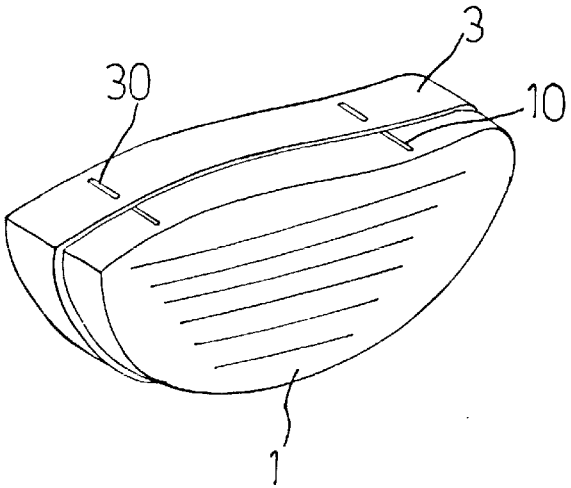
FIG. 2 is an assembled view of the movable body of this invention.
Figure 3:
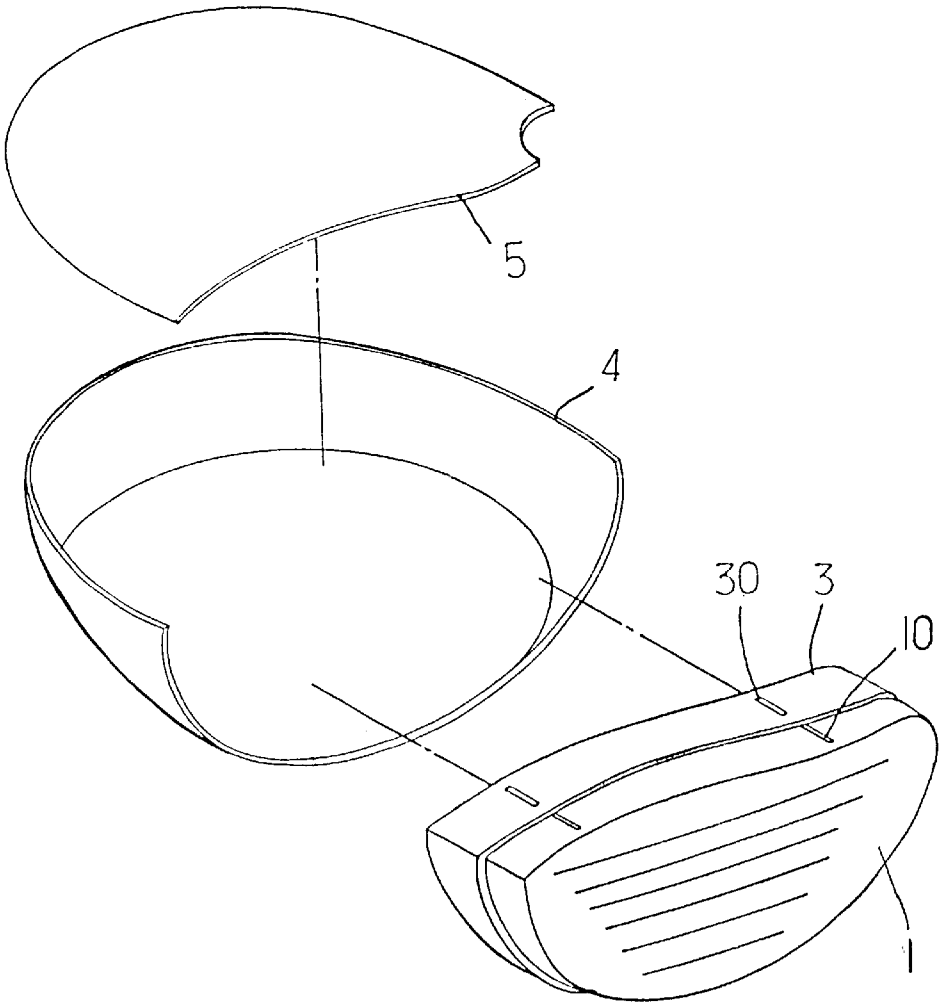
FIG. 3 is an exploded view of this invention in three dimensions.
Figure 4:
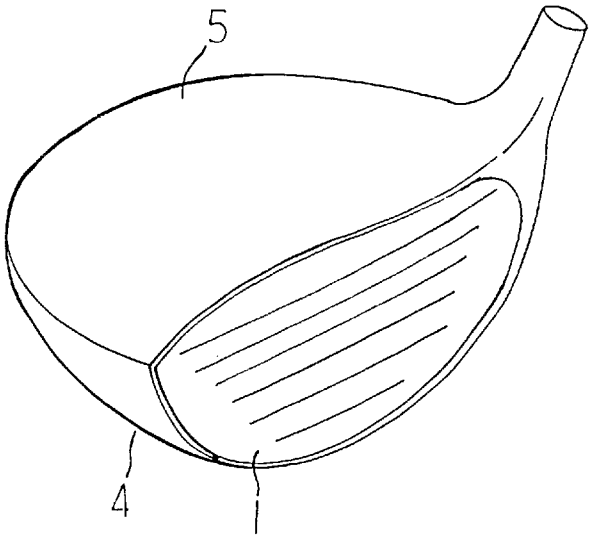
FIG. 4 is an elevational view of this invention in three dimensions.
Figure 5:
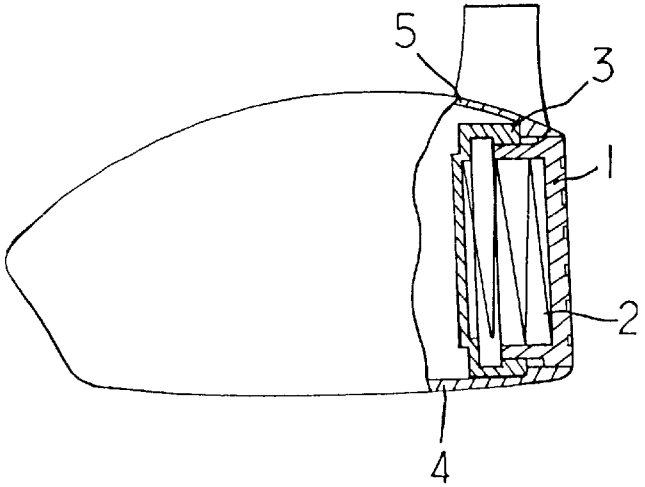
FIG. 5 is a cutaway sectional view of this invention in assembled.
Figure 6:
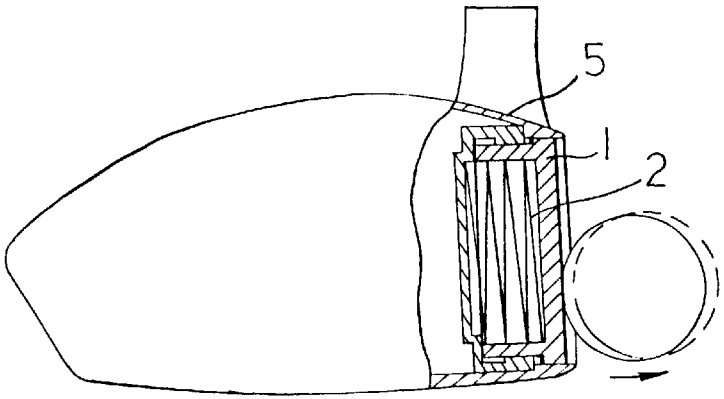
FIG. 6 is a schematic view showing action of this invention.

As shown in FIG. 1, in a golf club, a striking panel of club head of this invention is composed of a faceplate 1, at least a resilient elements 2, and a limitation stopper 3, wherein a plurality of positioning slots 10 of the faceplate 1 is engaged with corresponding positioning flanges 30 formed on the limitation stopper 3, then, the resilient element 2 are arranged in the enclosed space between the faceplate 1 and the limitation stopper 3 to form a movable casing of the striking panel before hand (shown in FIG. 2). The movable casing will be welded with a bottom plate 4 and an upper cover 5 respectively in a subsequent assembling job of a club head to complete fabrication of the club head (shown in FIG. 3, 4, 5). When striking a golf ball, the stretchable faceplate I is recessed to have the golf ball attached thereto within an infinitesimal period of time, and when the recessed faceplate 1 rebounds, the golf ball will suffer a secondary auxiliary elastic force to fly farther than used to do (shown in FIG. 6).

Figure 7:
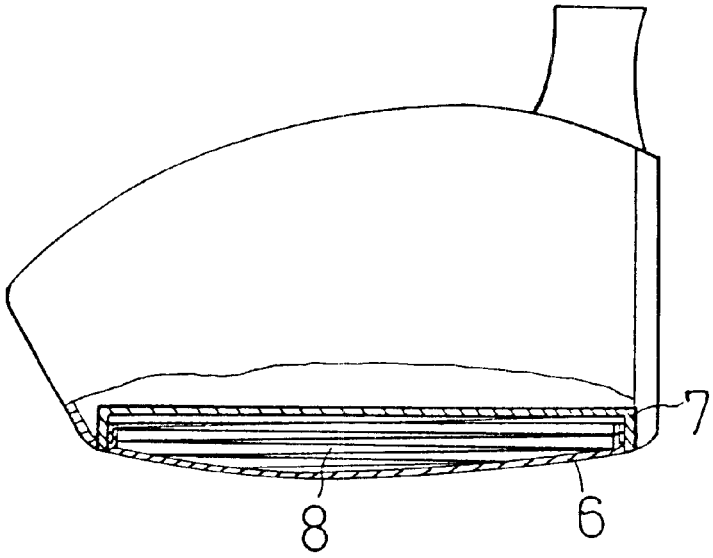
FIG. 7 is a cutaway sectional view showing a bottom plate of this invention.

FIG. 7 indicates that similar technique of movable body is applied to form another resilient movable casing by gathering a bottom plate 6, a limitation stopper 7, and at least a resilient element 8, then, the movable casing is combined with a main housing of club head for building a club head with resilient movable bottom plate. In a stroke to golf ball and in case the bottom plate strikes the ground or the grass, the movable bottom plate will recess to reduce the resistant force and allow the striking force going straightly.

Figure 9:
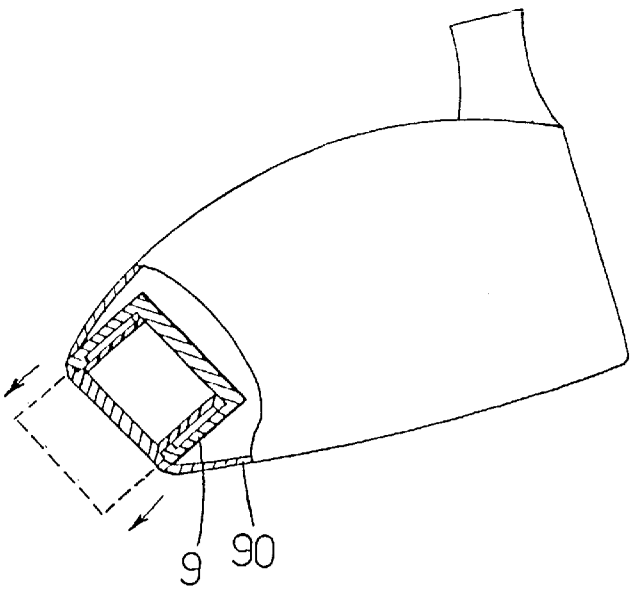
FIG. 9 illustrates displacement of center of gravity of this invention.
Figure 8:
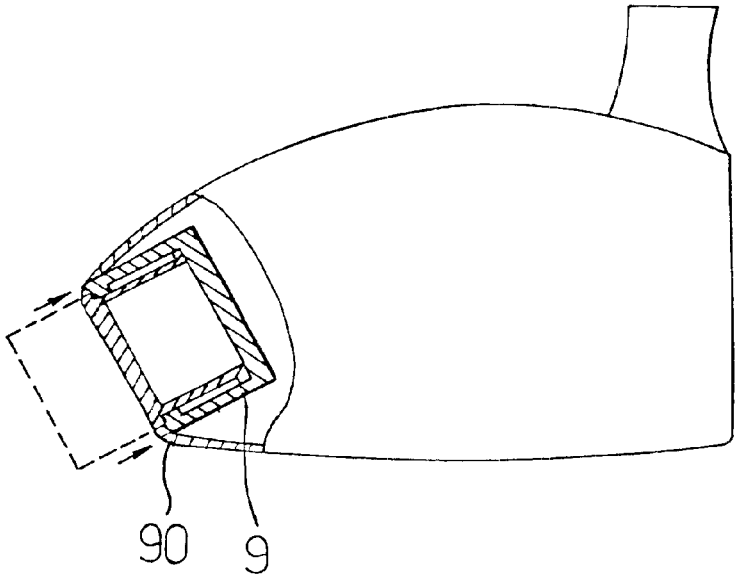
FIG. 8 is a cutaway sectional view showing a toe end of this invention.

FIG. 8 illustrates that a movable body 9 is disposed in toe end 90 of a club head for stabilizing center of gravity of the club head. In a circular striking action, the recessed movable body 9 starts to protrude to cause offset of the center of gravity of the club head and thereby to offer a smooth and stable stroke to the golf ball (shown in FIG. 9).

Although, this invention has been described in terms of preferred embodiments, it is apparent that numerous variations and modifications may be made without departing from the true spirit and scope thereof, as set forth in the following claims.

What is claimed is:

1. A golf club head having a main body housing comprising a striking face portion having a faceplate, a bottom portion having a bottom plate and an upper cover;

said main body housing further including at least a toe end portion;

said head having a plurality of resilient movable bodies disposed within a casing in each one of said striking portion, said bottom portion and said toe end portion;

each of said casings in said striking face portion and said bottom portion including a limitation stopper;

said movable body in said striking face portion being disposed between said faceplate and said limitation stopper, whereby when a ball strikes the faceplate, a secondary auxiliary force is created by the resilient movable body to increase the flying distance of the ball upon its release from the faceplate;

said movable body in said bottom portion being disposed between said bottom plate and said limitation stopper, whereby the resilient body in the bottom portion of the club head is configured to allow the bottom plate to recess slightly inwardly towards the main body in order to reduce the resistant force exerted on the main body when the bottom plate strikes the ground or grass;

said movable body in said toe portion configured to protrude slightly outwardly away from said main body during a circular striking motion to create an offset in the center of gravity of the club head.

2. The golf club head of claim 1 wherein said main body housing is connected to each of said casings by a plurality of positioning slots and positioning flanges.

* * * * *